US009138868B2

(12) United States Patent
McDowell et al.

(10) Patent No.: US 9,138,868 B2
(45) **Date of Patent: *Sep. 22, 2015**

(54) ABRASIVE CUTTING TOOL AND CUTTING METHOD

(71) Applicant: ATI Properties, Inc., Albany, OR (US)

(72) Inventors: Gary D. McDowell, Albany, OR (US); Brett R. Krueger, Lebanon, OR (US)

(73) Assignee: ATI Properties, Inc., Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/649,350

(22) Filed: Oct. 11, 2012

(65) Prior Publication Data

US 2013/0059502 A1 Mar. 7, 2013

Related U.S. Application Data

(63) Continuation of application No. 12/550,436, filed on Aug. 31, 2009, now Pat. No. 8,308,530.

(51) Int. Cl.

| | |
|---|---|
| ***B24B 5/00*** | (2006.01) |
| ***B24D 5/06*** | (2006.01) |
| ***B24B 5/40*** | (2006.01) |
| ***B24B 33/02*** | (2006.01) |
| ***B24B 33/08*** | (2006.01) |

(52) U.S. Cl.
CPC ... *B24D 5/06* (2013.01); *B24B 5/40* (2013.01); *B24B 33/02* (2013.01); *B24B 33/08* (2013.01)

(58) Field of Classification Search
CPC ..... B24B 5/40; B24B 33/02; B24B 33/10
USPC ..... 451/464, 465, 486
See application file for complete search history.

(56) References Cited

U.S. PATENT DOCUMENTS

| | | | | | |
|---|---|---|---|---|---|
| 1,898,786 | A | * | 2/1933 | Musheno | 451/484 |
| 1,972,890 | A | | 9/1934 | Hutto | |
| 2,000,611 | A | | 5/1935 | Prange | |
| 2,105,024 | A | | 1/1938 | Connor | |
| 2,265,377 | A | * | 12/1941 | Kline | 451/478 |
| 2,314,348 | A | | 3/1943 | Garand | |
| 2,353,409 | A | | 7/1944 | McClure | |
| 2,657,507 | A | | 11/1953 | Seymore | |
| 2,694,885 | A | | 11/1954 | Peden | |
| 2,815,615 | A | * | 12/1957 | Sunnen | 451/470 |
| 2,988,859 | A | | 6/1961 | Chaffey | |
| 3,330,078 | A | | 7/1967 | Von Tersch | |
| 3,362,112 | A | * | 1/1968 | Kirchner et al. | 451/465 |
| 3,672,102 | A | * | 6/1972 | Johnson | 451/540 |
| 4,328,647 | A | | 5/1982 | Gillette et al. | |
| 4,798,246 | A | | 1/1989 | Best | |

(Continued)

*Primary Examiner* — Maurina Rachuba
(74) *Attorney, Agent, or Firm* — K & L Gates LLP; John E. Grosselin, III

(57) ABSTRACT

A tool for removing material from a surface includes a body defining a longitudinal bore and an opening connecting an outer surface of the body to the longitudinal bore. A cutting element comprising a cutting surface is dimensioned to be at least partially received by the opening. The cutting surface is configured to translate from a first position to a second position in response to a centrifugal force. In the second position the cutting surface is extended outwardly through the opening, beyond the outer surface of the body. In one example, the tool may be used to remove material, such as oxidation, from the inner walls of a cylindrical article selected from a pipe and a tube.

37 Claims, 8 Drawing Sheets

(56) References Cited

U.S. PATENT DOCUMENTS 4,955,165 A * 9/1990 Brooks et al. ..... 451/464
5,233,791 A 8/1993 McQueen, Jr.
5,527,214 A * 6/1996 Estabrook ..... 451/470
6,254,467 B1 * 7/2001 Prosl ..... 451/465
2011/0053469 A1 3/2011 McDowell et al.

* cited by examiner

ABRASIVE CUTTING TOOL AND CUTTING METHOD

CROSS REFERENCE TO RELATED APPLICATIONS

This application is a continuation application claiming priority under 35 U.S.C. §120 to co-pending U.S. patent application Ser. No. 12/550,436, filed on Aug. 31, 2009.

BACKGROUND

The present disclosure is generally directed to tools for removing material from a surface involved in, for example, applications that require high-quality weld joints. High-quality weld joints may be achieved by autogenous welding, which is fusion welding without the use of filler metal. Autogenous welding is employed to join tubing used in, for example, many high-purity and sanitary tubing systems. Because these systems require high-quality weld joints, an emphasis is typically placed on obtaining a smooth, contaminant-free inner tube surface to avoid weld contamination.

In some applications, it may be necessary to form high-purity weld joints when joining zirconium tubing sections. A hard oxide layer forms on the inner and outer walls of air-annealed zirconium tubing. This oxide layer may approach 1200 kg/mm$^2$ hardness compared to the zirconium tubing hardness of about 190 kg/mm$^2$. In order to achieve a high-purity weld, prior to welding, at least a portion of this oxide layer should be removed from each end of the zirconium tubing to be joined together. By removing a portion of the oxide, weld bead contamination from dissolved oxygen can be reduced or prevented.

SUMMARY

According to one non-limiting aspect of the present disclosure, an abrasive cutting tool is provided that includes a body, where the body defines a longitudinal bore and an opening connecting an outer surface of the body to the longitudinal bore. The tool may comprise a cutting element comprising a cutting surface, where the cutting element is dimensioned to be at least partially received by the opening. The cutting surface may be configured to translate from a first position to a second position in response to a centrifugal force, such as during rotation of the tool. The cutting surface may be extended through the opening and beyond the outer surface of the body in the second position during rotation.

According to another non-limiting aspect of the present disclosure, a tool is disclosed comprising a body, where the body defines a longitudinal bore, a first opening connecting an outer surface of the body to the longitudinal bore, and a second opening connecting the outer surface of the body to the longitudinal bore. In various embodiments, the tool may comprise a first cutting element including a first abrasive pad and a first shoe. The first cutting element may be dimensioned to be at least partially received by the first opening. Further, the first cutting element may be translatable from a first position to a second position in response to a centrifugal force. The first abrasive pad may be extended through the first opening and beyond the outer surface of the body in the second position. The tool also may comprise a second cutting element including a second abrasive pad and a second shoe. The second cutting element may be dimensioned to be at least partially received by the second opening. Further, the second cutting element may be translatable from a first position to a second position in response to a centrifugal force. The second abrasive pad may be extended through the second opening and beyond the outer surface of the body in the second position.

According to yet another non-limiting aspect of the present disclosure, a method is disclosed for attaching a tool to a rotary device, retracting a cutting element of a tool into a body of the tool, placing the body of the tool in the end of a cylindrical article selected from a pipe and a tube, rotating the tool using the rotary device to extend a portion of the cutting element from the body using centrifugal force, and abrading an inner wall of the cylindrical article. The article may be, for example, zirconium, titanium, aluminum, or an alloy of any of those materials.

BRIEF DESCRIPTION OF THE DRAWINGS

The features and advantages of the apparatuses and methods described herein may be better understood by reference to the accompanying drawings in which.

The reader will appreciate the foregoing details, as well as others, upon considering the following detailed description of certain non-limiting embodiments according to the present disclosure. The reader also may comprehend certain of such additional details upon carrying out or using the tools and methods described herein.

DESCRIPTION OF CERTAIN NON-LIMITING EMBODIMENTS

In the present description of non-limiting embodiments and in the claims, other than in the operating examples or where otherwise indicated, all numbers expressing quantities or characteristics are to be understood as being modified in all instances by the term "about." Accordingly, unless indicated to the contrary, any numerical parameters set forth in the following description are approximations that may vary depending on the desired characteristics one seeks to obtain in the tools and methods according to the present disclosure. At the very least, and not as an attempt to limit the application of the doctrine of equivalents to the scope of the claims, each numerical parameter should at least be construed in light of the number of reported significant digits and by applying ordinary rounding techniques.

Generally, the present disclosure is directed toward systems, apparatuses, and methods for removing material from a surface. In certain non-limiting embodiments, the material is oxidation present on the inner wall of a cylindrical article such as a pipe or a tube. In certain non-limiting embodiments, the cylindrical article is a zirconium tube. It is appreciated, however, that the apparatuses, systems, and methods described herein may be used with articles composed of a variety of other materials, such as zirconium alloy, titanium, titanium alloy, aluminum, and aluminum alloy, for example. Furthermore, this disclosure is not limited to techniques for removing oxidation, but instead is intended to cover the removal of any type of scale or other material that may be removed from a surface using the tools and methods described herein.

Figure 1:
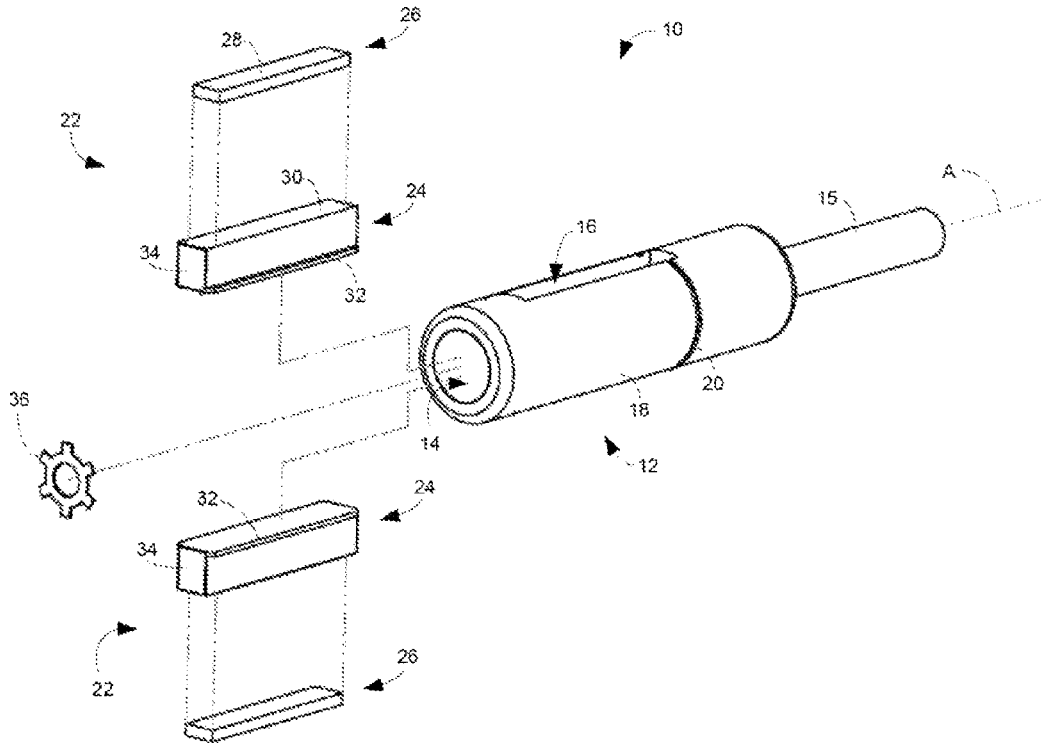
FIG. 1 is an exploded view of a tool in accordance with one non-limiting embodiment.

FIG. 1 is an exploded view of a tool 10 in accordance with one non-limiting embodiment. In one embodiment, the tool 10 comprises a body 12 and a shank 15. The shank 15 may be unitary with the body 12, or may be a separate component attached to and integral with the body 12. In one embodiment, the outside diameter of the shank 15 is about 0.25 inches. The shank 15 may have an outside diameter that is smaller relative to the outside diameter of the body 12. The shank 15 may be dimensioned to be received by a chuck or collet, for example, of a rotary device (not shown). The rotary device may be any suitable device for rotating the tool 10, such as an electric drill, a pneumatic drill, an electric die grinder, a pneumatic die grinder, or a lathe, for example. Furthermore, while the shank 15 is illustrated in FIG. 1 as having a general cylindrical shape, it is to be appreciated that the shank 15 may have any suitable shape, where a cross-section defines a circular, triangular, rectangular, pentagonal, hexagonal, or any other suitable bounded shape, such as a shape having multiple facets, defining any suitable geometry to match a corresponding chuck or collet, for example.

Still referring to FIG. 1, the body 12 also may define a longitudinal opening such as a bore 14. The bore 14 may be centered on and parallel to a longitudinal axis (shown as "A") of the tool 10. In some embodiments, the bore 14 is a blind hole and therefore does not extend the entire longitudinal length of the body 12. The body 12 also may define one or more openings 16. In one embodiment, the opening 16 is generally parallel to the longitudinal axis A and is a rectangular slot. As described in more detail below, however, the openings 16 may be any suitable size, shape, and configuration. In various embodiments, the openings may be triangular, quadrangular (e.g., square, rectangle, rhomboidal), circular, oval, or any combination, for example. Additionally, the openings in the body may have any suitable angular orientation relative to the longitudinal axis A. For example, in some embodiments, the openings may be generally perpendicular to the longitudinal axis A or may be oblique to the longitudinal axis A. Furthermore, the openings may have straight edges, as illustrated in FIG. 1, curved edges, or a combination of both. In some embodiments, the openings 16 may generally spiral around the body 12. The openings 16 may connect an outer surface 18 of the body 12 to the bore 14 to create passageways in the body 12. The body 12 also may comprise a reference line 20. The reference line 20 may be, for example, a machined groove spanning the periphery of the body 12. The reference line 20 may serve as a visual depth indicator during use of the tool 10.

The tool 10 further may comprise a cutting element 22. The number of cutting elements 22 implemented for any particular embodiment may correspond to the total number of openings in the body 12. The cutting element 22 may comprise a shoe 24 and an abrasive pad 26 attached to a surface 30 of the shoe 24. The abrasive pad 26 may be attached to the surface 30 using any suitable adhesive, such as an epoxy, or other attachment technique suitable for withstanding the heat, pressure, and centrifugal forces experienced during use of the tool. In one embodiment, one side of the adhesive pad 30 is sandblasted to accept a LOCKTITE® epoxy.

The abrasive pad 26 may comprise a cutting surface 28. In one embodiment, the abrasive pad 26 comprises a diamond grit (or other abrasive) dispersed in a resin (or other binder) to create a continuous pad. A diamond abrasive is a relatively hard material and the bond has a tendency to break down during use. This breakdown helps clean the cutting surface 28, prevent plugging of the cutting surface, and expose new sharp diamond particles to aid in the abrading process. In various embodiments, other abrasives may be implemented, such as boron carbide, silicon carbide, aluminum oxide, and/or zirconia alumina, for example.

Still referring to FIG. 1, the shoe 24 may comprise a shoulder 32. The shoulder 32 may be any suitable configuration. For example, the shoulder 32 may extend the length of the shoe 24 (as illustrated) or may extend across a face 34. In some embodiments, the shoulder 32 may be located on one, two, three, or four sides of the shoe 24. Furthermore, the shoulder 32 may be continuous, as illustrated, or may be intermittent, such as a series of pins or teeth.

The abrasive pad 26 may be any suitable dimensions, such as about 0.187 inches wide, about 0.060 inches high, and about 1.0 inches long. The shoe 24 also may have any suitable dimensions. For example, if the shoe 24 is generally rectangular, the shoe 24 may be about 0.187 inches high, about 0.25 inches wide, and about 1.187 inches long. Furthermore, the openings 16 may have dimensions about 0.010 inches longer than the shoe 24 and about 0.005 inches wider than the shoe 24. As is to be appreciated, the total width of the shoe 24 and the shoulder 32 will be greater than the width of the opening 16. Similarly, if the shoulder 32 is formed on the face 34 of the shoe 24, than the total length of the shoe 24 and the shoulder 32 will be greater than the length of the opening 16. Therefore, the shoulder 32 serves to restrain the shoe 24 from completely exiting the tool 10 through the opening 16. The outer diameter of the body 12 may be determined based at least in part on the intended application. In one embodiment, if the tool 10 is used to remove oxidation from the inner wall of a cylindrical pipe, the outside diameter of the body 12 may be approximately 95% of the pipe's inside diameter. As is to be appreciated upon consideration of the disclosure, the tool 10 may be used to abrade a variety of surfaces, such as flat surfaces, and, for example, pipes and tubes of varying shapes and sizes. The various components of the tool 10, such as the shoes 24 and the abrasive pad 26, may be sized based on the application.

As illustrated in FIG. 1, the cutting elements 22 may be received in the bore 14. Each opening 16 may receive a cutting element 22. Once all of the cutting elements 22 have been positioned in the openings 16, a retaining device 36 may be placed within the bore 14 to prevent the cutting elements 22 from exiting the bore 14. In one embodiment, the retaining device 36 is a self-locking retaining ring (McMaster-Carr part no. 98435A134). In other embodiments, other types of retaining devices may be used, such as a threaded cap, or a friction-fitted plug, for example.

Figure 2:
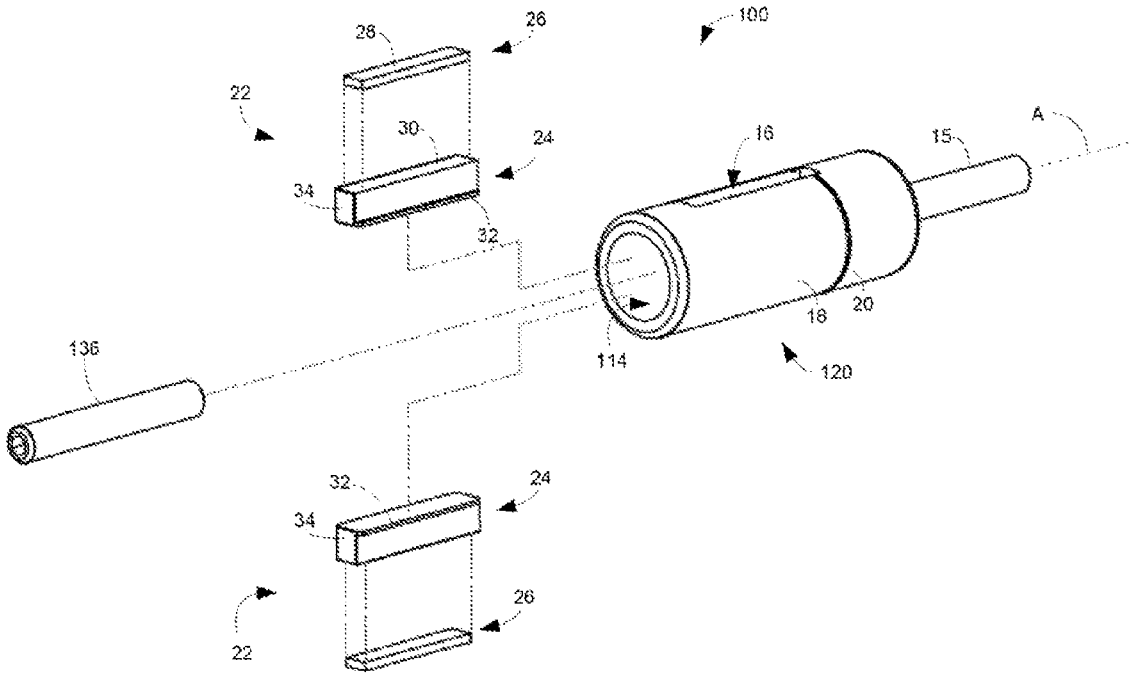
FIG. 2 is an exploded view of a tool in accordance with one non-limiting embodiment.

FIG. 2 is an exploded view of another embodiment of a tool 100 in accordance with one non-limiting embodiment. As illustrated, a body 120 of the tool 100 has an outside diameter that is larger relative to the diameter of the body 12 (FIG. 1). Additionally, the body 120 defines a bore 114 that is larger in diameter than the diameter of the bore 14 (FIG. 1). Due to the relatively larger diameter of the bore 114, a set screw 136 may be installed inside the bore 114 once the cutting elements 22 have been inserted into the body 120. When installed, the set screw 136 prohibits the cutting elements 22 from exiting the tool 100. In one embodiment, the set screw 136 may be about 1.75 inches long comprising a ¼-20 socket head set screw. It is to be appreciated that the dimensions of the set screw 136 may be dependent on the diameter of the bore 114 and the size of the cutting elements 22.

Figure 3A:
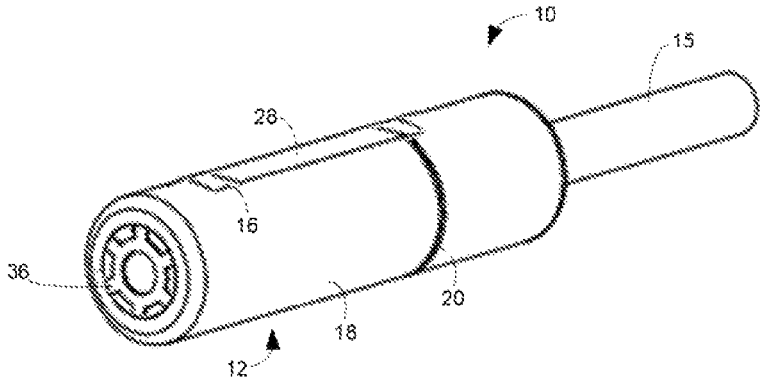
FIGS. 3A and 3B illustrate an embodiment of the tool of FIG. 1 in a stationary-state configuration and in a dynamic-state configuration, respectively.
Figure 3B:
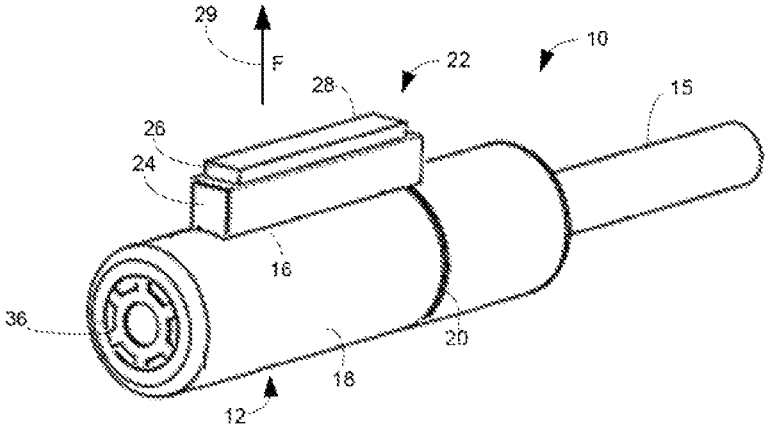

FIGS. 3A and 3B illustrate a non-limiting embodiment of the tool 10 in a stationary-state configuration (FIG. 3A) and a dynamic-state configuration, e.g., during rotation (FIG. 3B). The stationary-state configuration is present when the tool 10 is not rotating, while the dynamic-state configuration is present during rotation of the tool 10. In the stationary state, the shoe 24 and the abrasive pad 26 are freely slidably movable (e.g., float) within the opening 16 in the body 12. Once the tool 10 is rotated, the cutting elements 22 are driven outwardly, or radially, from the body 12 in response to the centrifugal force "F" in the direction indicated by arrow 29. During rotation the cutting surface 28 is extended through the opening 16 and beyond the outer surface 18 of the body 12. The shoulder 32 (FIG. 1) prevents the cutting element 22 from exiting the opening 16 during rotation. Thus, each of the cutting elements 22 has at least two positions within the tool 10. The first, stationary position is illustrated in FIG. 3A. In this position, the abrasive pad 26 is not extended to its abrading position. The second, dynamic position is illustrated in FIG. 3B. In the second position, the abrasive pad 36 is in its dynamic-state abrading position.

Figure 4:
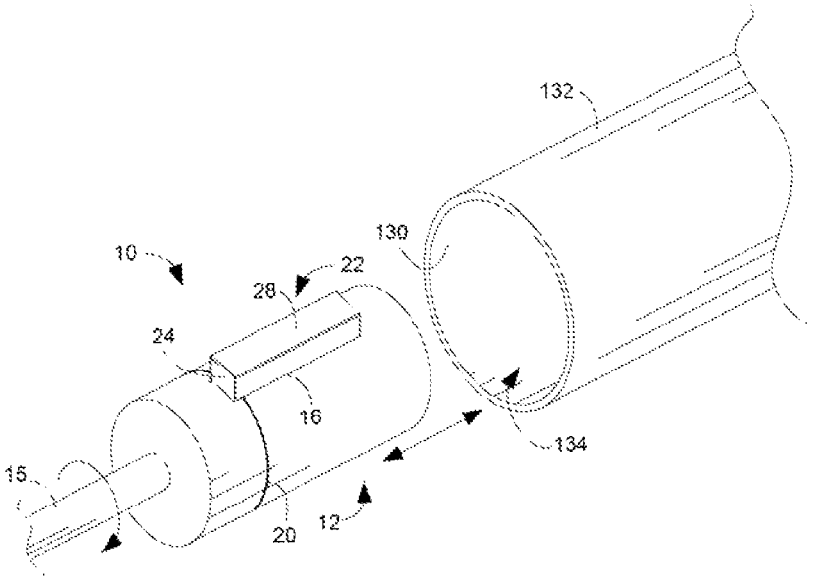
FIG. 4 illustrates one non-limiting embodiment of a method of removing oxidation from an inner wall of a pipe using the embodiment of a tool shown in FIG. 1.

FIG. 4 illustrates a technique for using the tool 10 to abrade the inner wall 130 of a pipe 132. In one embodiment, the user may manually push the cutting element 22 into the opening 16 to reduce the total outside diameter of the tool 10 to a size smaller than the inside diameter of the pipe 132. In the stationary-state configuration, the tool 10 may then be introduced into an opening 134 of the pipe 132. Once the tool 10 is in position within the pipe 132, the tool 10 may be rotated by any suitable technique, such as a pneumatic die grinder (not shown). When rotating, the cutting surface 28 is forced outwardly in the direction indicated by arrow 29 from the body 12 and may contact the inner wall 130 of the pipe 132. The force of the cutting surface 28 against the inner wall 130 of the pipe 132 may abrade, e.g., grind away, material, such as oxidation, on the inner wall 130. The feed pressure exerted by the cutting surface 28 against the inner wall 130 may be adjusted by adjusting, for example, the rotational speed of the tool 10 and/or the weight of the cutting element 22. Generally, if the cutting element 22 has more mass, a higher feed pressure will result. The reference line 20 allows the operator to visually determine if the abrasive pad 24 is nearing the opening 134 of the pipe 132. If the abrasive pad 24 is partially withdrawn from the pipe 132 during operation, the abrasive pad 24 may experience uneven wear resulting in uneven oxide removal and shortened pad life. Therefore, the reference line 20 can alert the user that the abrasive pad 24 is nearing the end of the pipe 132.

In operation, the cutting element 22 floats within the opening 16 and may follow the internal contours of the pipe 132 and adjust to any variations from roundness as the tool 10 rotates. Furthermore, in some embodiments the material of the body 12 and the shoe 24 may be similar or identical to the material of the pipe 132. Matching materials helps to prevent internal cross contamination by the body 12 and the shoe 24 if these features contact the pipe 132. For example, in some embodiments the body 12 and the cutting elements 22 may be made of or comprise titanium if the tool 10 is to be used with titanium piping. Similarly, if the tool 10 is to be used with zirconium piping, the body 12 and the cutting elements 22 may be made of or comprise zirconium, for example.

The configuration of the cutting elements 22 may vary. For example, in some embodiments, the cutting element 22 may comprise a shoe 24 and an abrasive pad 26 (FIG. 1). In other embodiments, the cutting element 22 may only comprise an abrasive pad 26 configured to extend through the opening 16 as the tool rotates. As is to be appreciated, the size or weight of the abrasive pad 26 may be adjusted to alter the feed pressure and performance of the abrasive pad.

Figure 7:
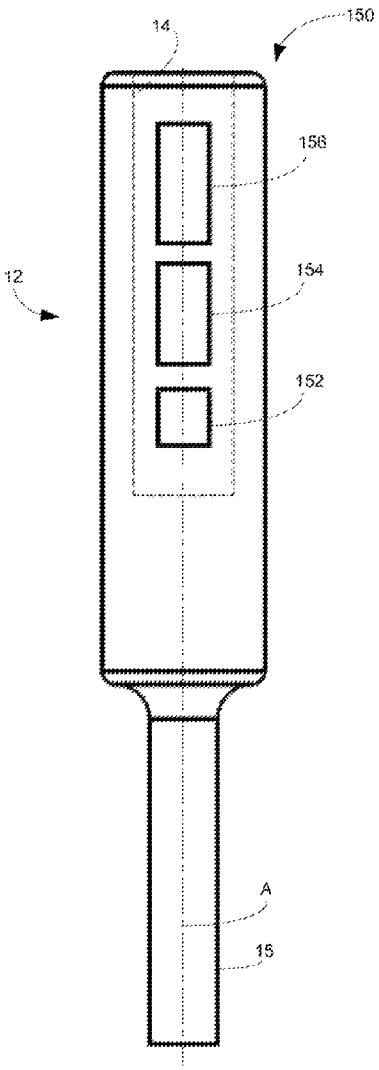
FIG. 5 through FIG. 9 illustrate various embodiments of openings in the body of a tool in accordance with various non-limiting embodiments.
Figure 6:
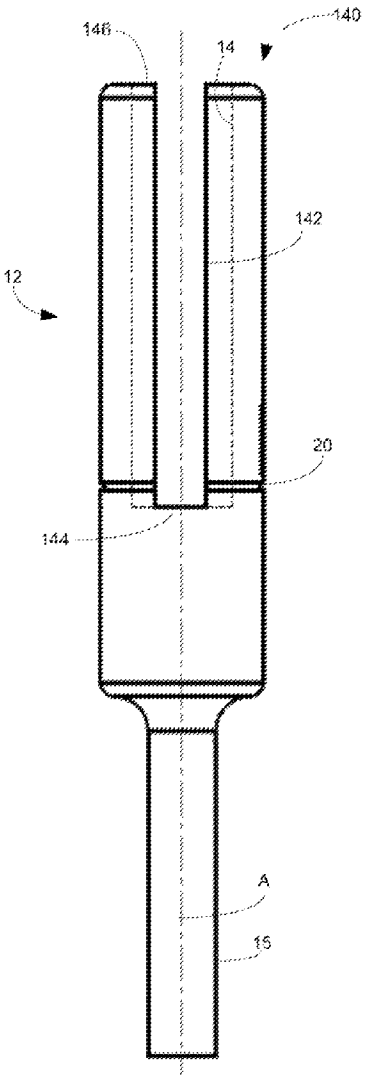
Figure 5:
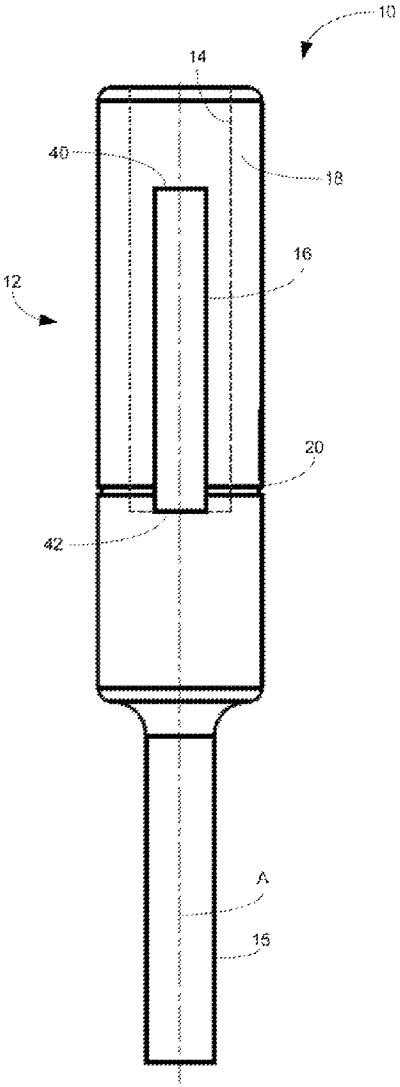
Figure 9:
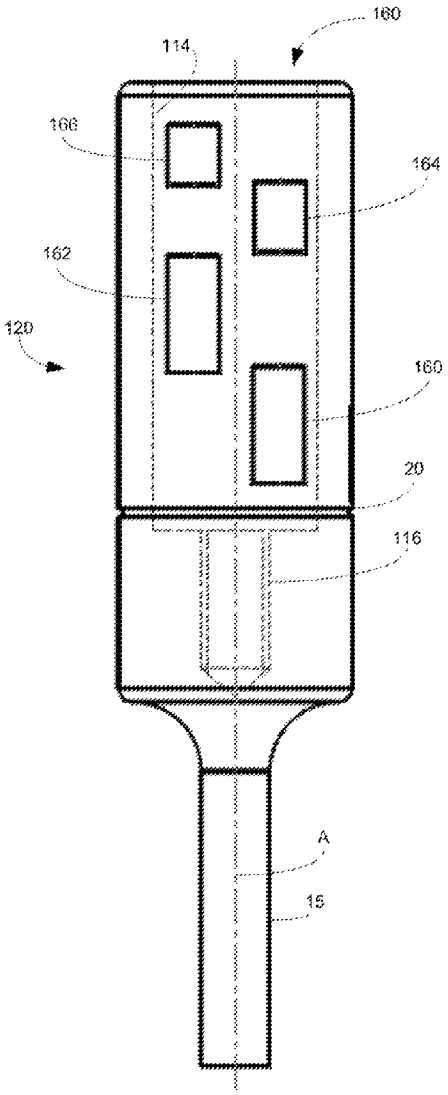
Figure 8:
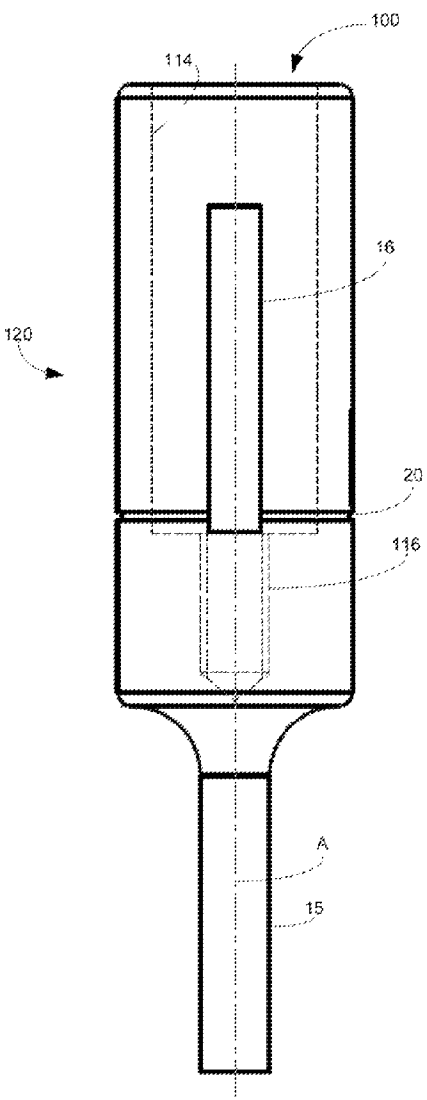

FIG. 5 through FIG. 9 illustrate side views of various embodiments of openings 16 in the body 12 of the tool 10. FIG. 5 is a side view of the tool 10 in FIG. 1, illustrated without cutting elements, in accordance with one non-limiting embodiment. The opening 16 may have a distal end 40 and a proximal end 42. As illustrated, the bore 14 (shown in shadow line) may extend into the housing 12 to a depth substantially aligned with the proximal end 42 of the opening 16. FIG. 6 is a side view of an embodiment of a tool 140, illustrated without cutting elements, in accordance with one non-limiting embodiment. The opening 142 includes a proximal end 144. As illustrated, the opening 142 extends from the proximal end 144 to the distal end 146 of the tool 140. As is to be appreciated, a cutting element (not shown) or set of cutting elements, may be positioned within the opening 142 and a retaining device, such as the retaining device 36 (FIG. 1), may be positioned within the bore 14 to retain the cutting elements in place. FIG. 7 is a side view of an embodiment of a tool 150, illustrated without cutting elements, in accordance with one non-limiting embodiment. As illustrated, the tool 150 may comprise a plurality of openings 152, 154, 156. The openings 152, 154, 156 may vary in size and orientation. Furthermore, the cutting elements associated with each opening 152, 154, 156 may be sized accordingly. For example, the cutting element for use with the opening 156 may be longer than a cutting element for use with the opening 152. FIG. 8 is a side view of the tool 100 in FIG. 2, illustrated without cutting elements, in accordance with one non-limiting embodiment. In this embodiment, due to the relatively large diameter of the bore 114, a set screw 136 (FIG. 2) may be used to retain the cutting elements. The set screw 136 may be received by a bore 116. The bore 116 may be threaded and centered on the longitudinal axis A of the tool 100. FIG. 9 is a side view of an embodiment of tool 160, illustrated without cutting elements, in accordance with one non-limiting embodiment. As illustrated, the tool 160 may have a plurality of openings 160, 162, 164, 166. The openings 160, 162, 164, 166 may be staggered with respect to the longitudinal axis A. Furthermore, while the openings 160, 162, 164, 166 are illustrated as rectangular, it is appreciated that the openings may be any shape, such as triangular, quadrangular (e.g., square, rectangle, rhomboidal), circular, oval, or any combination, for example.

Figure 10:
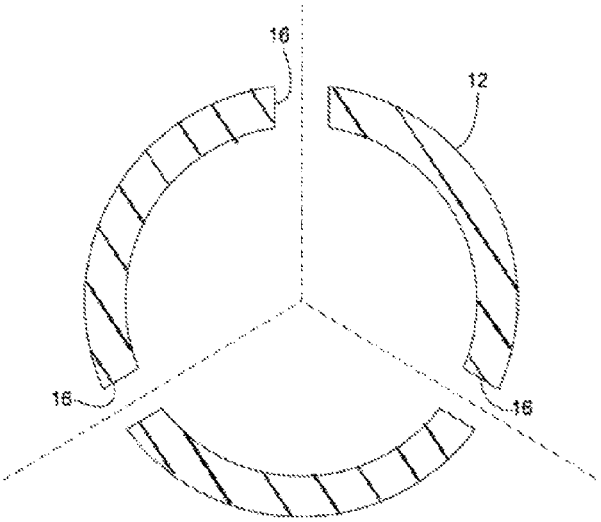
FIG. 10 through FIG. 12 are cross-sectional views of tool bodies illustrating opening configurations in accordance with various non-limiting embodiments.
Figure 11:
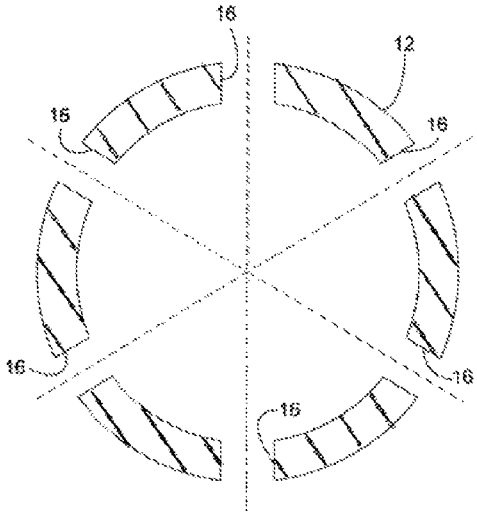
Figure 12:
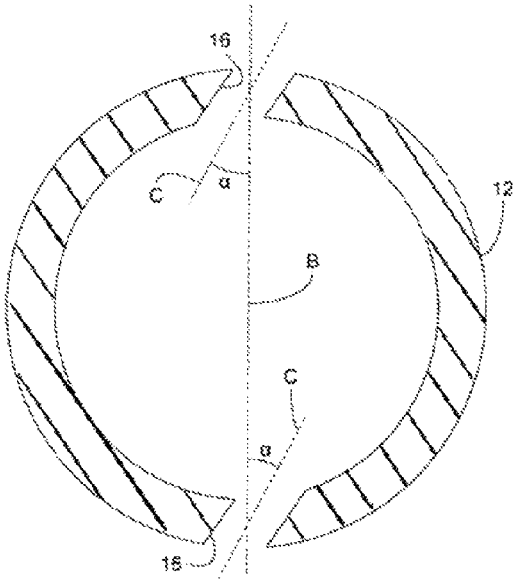

FIG. 10 through FIG. 12 are cross-sectional views of tool bodies illustrating opening configurations for various embodiments. In various embodiments, a plurality of openings may be distributed equidistantly around the periphery of the body 12. FIG. 10 illustrates three openings 16 equally spaced around the circumference of the body 12. Accordingly, the openings 16 are disposed at about 120-degree intervals. While each opening 16 is illustrated as having similar widths, it is appreciated that the width of each opening may vary. FIG. 11 illustrates an embodiment with six openings 16 equally spaced around the circumference of the body 12. In this embodiment, the openings 16 are separated by 60 degrees. FIG. 12 illustrates an embodiment with two openings 16 disposed at about 180-degree intervals. The openings 16 are oblique to a radial axis (shown as "B"). In this embodiment, the center axis (shown as "C") is offset the radial axis B by an angle α.

Figure 13:
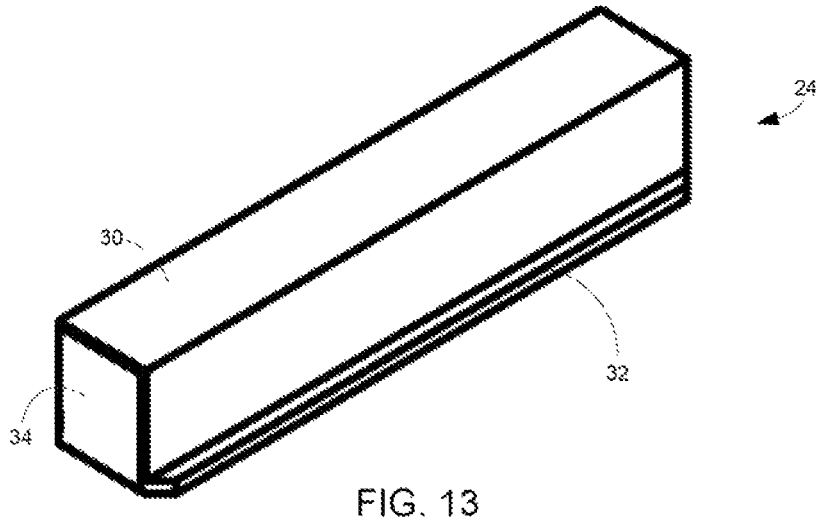
FIG. 13 through FIG. 17 illustrate the shoes of the tool embodiment of FIG. 1 in accordance with various non-limiting embodiments.
Figure 14:
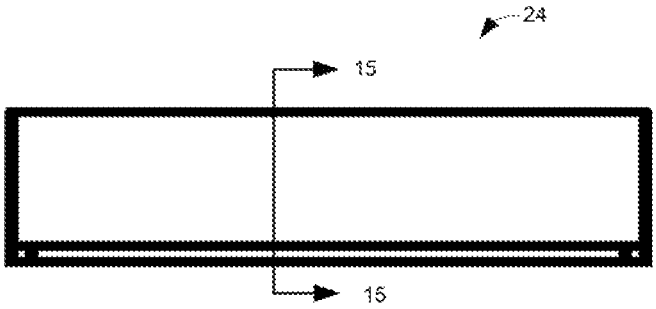
Figure 15:
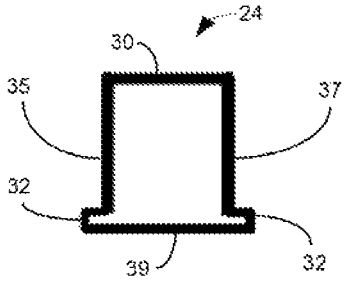
Figure 16:
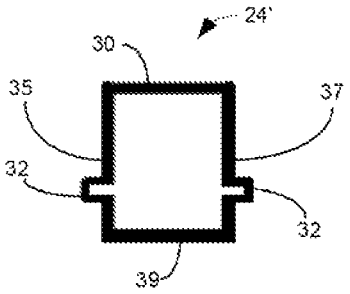
Figure 17:
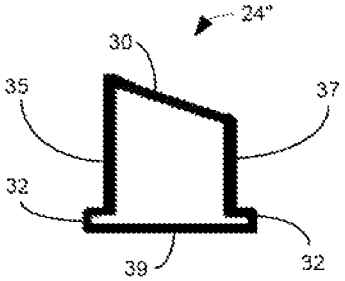

FIG. 13 through FIG. 17 illustrate the shoe 24 in accordance with various embodiments. FIG. 13 is a perspective view of the shoe 24. As previously described, an abrasive pad, or other type of cutting device, may be attached to a surface 30 of the shoe 24. As shown, the shoe 24 may comprise a shoulder 32. FIG. 14 is a side view of the shoe 24 of FIG. 13. FIG. 15 is a cross-sectional view of the shoe 24 of FIG. 14 taken along line 15-15. The shoe 24 may have a shoulder 32 protruding from both a first side 35 and a second side 37. The shoulder 32 generally may be aligned with a side 39 of the shoe 24, e.g., a bottom side as illustrated. As illustrated in FIG. 16, the shoulder 32 of a shoe 24' may be positioned at any suitable position on the first side 35 and the second side 37. For example, the shoulder 32 may be vertically offset from the side 39 of the shoe 24'. Additionally, as illustrated by a shoe 24" in FIG. 17, the surface 30 may be non-parallel in relation to the bottom side 39. In some embodiments, the shoe 24 may comprise a tip in the form of a chisel tip, for example. While various embodiments of the shoe 24 have been described, it is to be appreciated that the size, shape, and orientation of the shoe 24 may vary.

Figure 18:
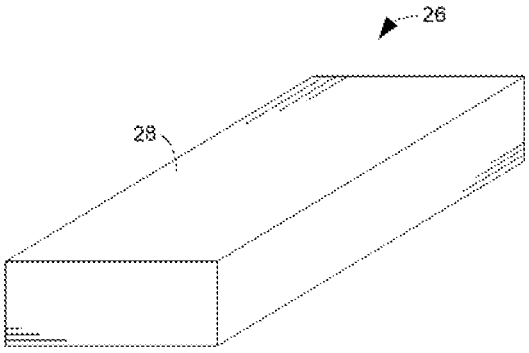
FIG. 18 through FIG. 21 illustrate abrasive pads in accordance with various non-limiting embodiments.
Figure 19:
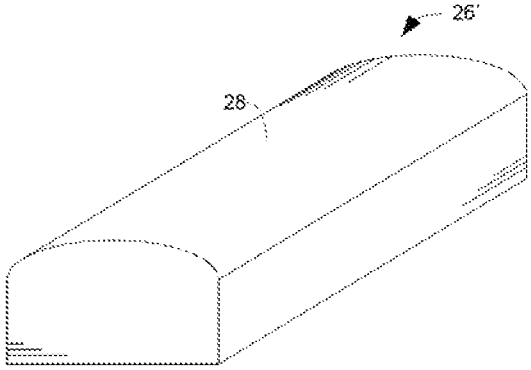
Figure 20:
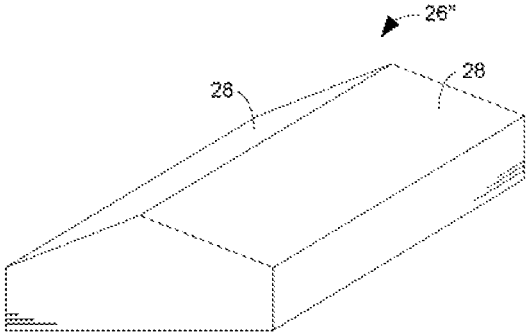
Figure 21:
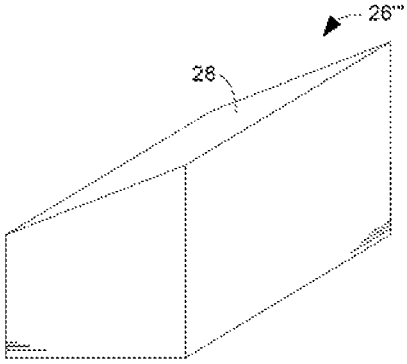

FIG. 18 through FIG. 21 illustrate abrasive pads in accordance with various embodiments. FIG. 18 illustrates the abrasive pad 26 of FIG. 1 having generally a rectangular configuration. In various embodiments, however, the size, shape, and orientation of the abrasive pad 26 and the cutting surface 28 may vary. FIG. 19 illustrates an abrasive pad 26' comprising a rounded cutting surface 28. FIG. 20 illustrates an abrasive pad 26" comprising two slanted cutting surfaces 28. FIG. 21 illustrates an abrasive pad 26'" comprising a single slanted cutting surface 28. In other embodiments, the cross-section of the abrasive pad may define a variety of other shapes, such as a parallelogram, for example. Also, various edges of the abrasive pad may be rounded or chamfered. The abrasive pads may be configured to attach to a shoe, or may function without the use of a shoe. As is to be appreciated, a plurality of different abrasive pads, each with a different shape, may be implemented in a single tool. Additionally, a first set of abrasive pads may be configured for a first application, while a second set of abrasive pads may be configured for a second application. An operator of the tool may then insert the set of abrasive pads into the tool that are application appropriate.

Figure 22A:
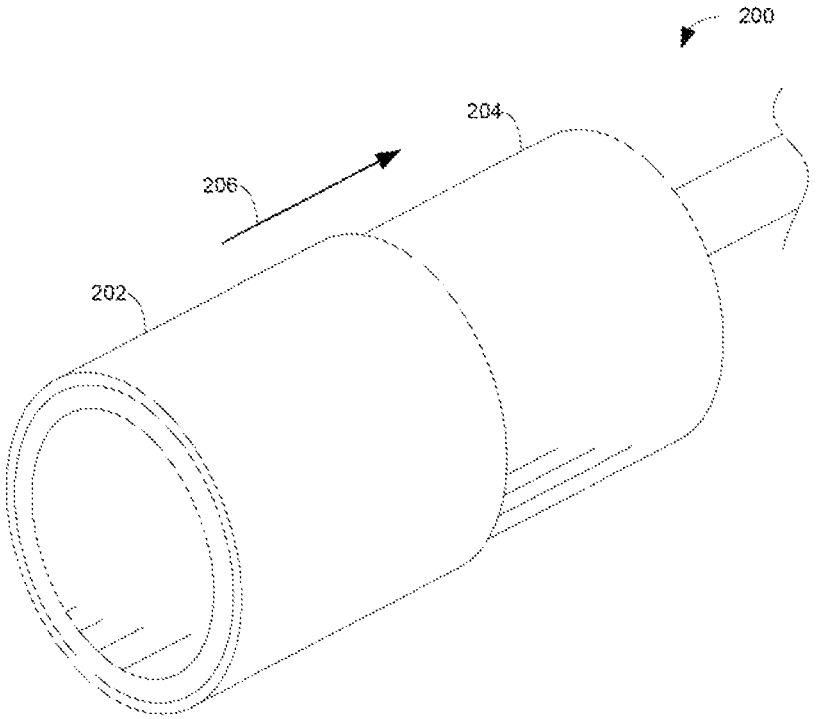
FIGS. 22A and 22B illustrate an embodiment of a tool in accordance with one non-limiting embodiment.
Figure 22B:
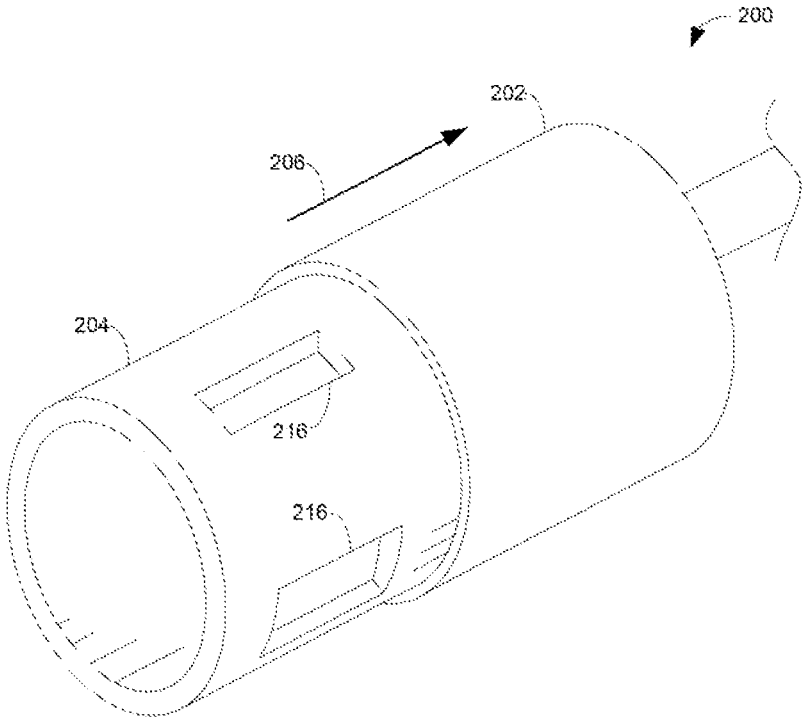

FIGS. 22A and 22B illustrate an embodiment of a tool 200 in accordance with one non-limiting embodiment. The tool 200 may comprise a sheath 202 that surrounds a body 204. The sheath 202 may be translatable from a first position (shown in FIG. 22A) to a second position (shown in FIG. 22B) through movement in the direction indicated by arrow 206. When the sheath 202 in the second position, openings 216 in the body 204 may be exposed. The sheath 202 may surround the entire body 204, as illustrated, or may surround a portion of the body 204. Similar to previously described embodiments, cutting elements (not shown) may extend from the openings 216 during use of the tool 200. In some embodiments, the sheath 202 may be biased in the first position using any suitable method, such as a spring or other biasing technique. The cutting elements used with tool 200 may vary in design. For example, in some embodiments the cutting element does not comprise a retaining shoulder. Instead, the sheath 202 retains the cutting elements in the body 204 when the sheath is in the first position. During use of the tool 200, the inner wall of the tubing being conditioned for welding keeps the cutting elements from completely exiting the body 204 through the openings 216.

The tool 200 may be sized for particular applications. For example, the body 204 may have a diameter that is smaller than the inner diameter of a particular tube. The sheath 202, however, may have a diameter that is larger than the inner diameter of the oxidized tube. Therefore, when an operator inserts the tool 200 into the end of the tube, the tube wall engages the sheath 202 while the body 204 enters the tube. Rotation of the tool 200 centrifugally extends the cutting elements through the openings and abrades the inner wall of the tube. Upon removal of the tool 200 from the tube, the sheath 202 may return to the first position, either manually or through a biasing force.

Numerous specific details have been set forth herein to provide a thorough understanding of the embodiments. It will be understood by those skilled in the art, however, that the embodiments may be practiced without these specific details. In other instances, well-known operations and components have not been described in detail so as not to obscure the embodiments. It can be appreciated that the specific structural and functional details disclosed herein may be representative and do not necessarily limit the scope of the embodiments.

It is also is noted that any reference to "one embodiment" or "an embodiment" means that a particular feature, structure, or characteristic described in connection with the embodiment is included in at least one embodiment. Also, the uses herein of the phrase "in one embodiment" do not necessarily refer to the same embodiment.

While certain features of non-limiting embodiments have been described and illustrated herein, many modifications, substitutions, changes, and equivalents will occur to those skilled in the art after reviewing the present disclosure. The appended claims are intended to cover all such modifications, substitutions, changes, and equivalents as fall within the true scope of the present disclosure.

What is claimed is:

1. An abrasive cutting tool, comprising:

a body defining a substantially cylindrical outer surface, a longitudinal bore having a longitudinal axis, and an opening in the substantially cylindrical outer surface connecting the outer surface of the body to the longitudinal bore; and a cutting element comprising a cutting surface, wherein the cutting element is at least partially received within the opening and the cutting element linearly slides within the opening in the body along an axis substantially perpendicular to the longitudinal axis from a first position to a second position in response to a centrifugal force, wherein in the first position the cutting surface of the cutting element is retained in the body and does not extend beyond the outer surface, and wherein in the second position the cutting surface of the cutting element extends outwardly through the opening beyond the outer surface of the body.

2. The abrasive cutting tool of claim 1, further comprising a retaining device positioned within the longitudinal bore.

3. The abrasive cutting tool of claim 1, further comprising a set screw having a longitudinal axis positioned within the longitudinal bore such that the longitudinal axis of the set screw is coaxial with the longitudinal axis of the bore.

4. The abrasive cutting tool of claim 3, wherein the body defines a second longitudinal bore configured to receive the set screw.

5. The abrasive cutting tool of claim 1, further comprising:

a plurality of the openings connecting the outer surface of the body to the longitudinal bore; and a plurality of the cutting elements, wherein each cutting element is at least partially received by an opening, is configured to translate from a first position to a second position in response to a centrifugal force, and wherein in the first position a cutting surface of the cutting element is retained in the body, and wherein in the second position the cutting surface of the cutting element extends outwardly through the opening beyond the outer surface of the body.

6. The abrasive cutting tool of claim 5, wherein the openings are distributed equidistantly around the periphery of the body.

7. The abrasive cutting tool of claim 1, wherein the cutting element comprises a shoulder.

8. The abrasive cutting tool of claim 1, wherein the cutting element comprises a shoe.

9. The abrasive cutting tool of claim 1, further comprising a reference line formed on the periphery of the body.

10. The abrasive cutting tool of claim 1, wherein the opening comprises a distal end and a proximal end, wherein a depth of the longitudinal bore is substantially aligned with the proximal end of the opening.

11. The abrasive cutting tool of claim 1, wherein the cutting element is manually movable from the second position to the first position.

12. An abrasive cutting tool, comprising:

a body defining an outer surface, a longitudinal bore, a first opening connecting the outer surface to the longitudinal bore, and a second opening connecting the outer surface to the longitudinal bore;

a first cutting element comprising a first cutting surface, wherein the first cutting element is at least partially received within the first opening and is configured to translate from a first position to a second position in response to a centrifugal force, wherein in the first position the first cutting surface of the first cutting element is retained in the body and does not extend beyond the outer surface, and wherein in the second position the first cutting surface of the first cutting element extends outwardly through the first opening beyond the outer surface of the body; and a second cutting element comprising a second cutting surface, wherein the second cutting element is dimensioned to be at least partially received within the second opening and is configured to translate from a first position to a second position in response to a centrifugal force, wherein in the first position the second cutting surface of the second cutting element is retained in the body and does not extend beyond the outer surface, and wherein in the second position the second cutting surface of the second cutting element extends outwardly through the second opening beyond the outer surface of the body.

13. The abrasive cutting tool of claim 12, further comprising a self-locking retaining ring positioned within the longitudinal bore.

14. The abrasive cutting tool of claim 12, further comprising a set screw having a longitudinal axis positioned within the longitudinal bore such that the longitudinal axis of the set screw is coaxial with the longitudinal axis of the bore.

15. The abrasive cutting tool of claim 12, further comprising a sheath translatable from a first position to a second position, wherein the sheath surrounds a portion of the body when in the first position.

16. The abrasive cutting tool of claim 12, wherein the first opening is rectangular and the second opening is rectangular.

17. A method comprising:

attaching a tool to a rotary device, the tool comprising a body comprising a longitudinal axis, a substantially cylindrical outer surface, an opening in the substantially cylindrical outer surface, and a translatable cutting element including a cutting surface;

retracting the translatable cutting element including the cutting surface into the body of the tool so that the cutting surface does not extend beyond the outer surface;

placing at least a portion of the body of the tool into a cylindrical article selected from a pipe and a tube;

rotating the tool using the rotary device to generate centrifugal force and thereby urge the cutting element to linearly slide within the opening along an axis substantially perpendicular to the longitudinal axis of the body so that the cutting surface extends outwardly from the outer surface of the body; and abrading an inner wall of the cylindrical article with the cutting surface as the tool rotates within the cylindrical article.

18. The method of claim 17, wherein the body defines a longitudinal bore and an opening connecting the outer surface of the body to the longitudinal bore, and wherein the cutting element is at least partially received within the opening.

19. The method of claim 17, wherein the body of the tool and at least a portion of the cutting element are comprised of the same material as the cylindrical article.

20. The method of claim 17, wherein at least the cutting surface of the cutting element comprises a diamond grit abrasive.

21. The method of claim 17, further comprising adjusting the cutting surface within the cylindrical article to follow the inner wall of the cylindrical article.

22. An abrasive cutting tool, comprising:

a body defining a longitudinal bore and an opening connecting the outer surface of the body to the longitudinal bore;

a cutting element comprising a cutting surface, wherein the cutting element is dimensioned to be at least partially received by the opening, the cutting surface is configured to translate from a first position to a second position in response to a centrifugal force, wherein in the first position the cutting surface does not extend beyond the outer surface, and wherein in the second position the cutting surface extends outwardly through the opening beyond the outer surface of the body; and a reference line formed on the periphery of the body.

23. The abrasive cutting tool of claim 22, wherein in the first position the cutting surface of the cutting element is retained in the body.

24. The abrasive cutting tool of claim 22, further comprising a retaining device positioned within the longitudinal bore.

25. The abrasive cutting tool of claim 22, further comprising a set screw having a longitudinal axis positioned within the longitudinal bore such that the longitudinal axis of the set screw is coaxial with the longitudinal axis of the bore.

26. An abrasive cutting tool, comprising:

a body defining an outer surface, a longitudinal bore, and an opening connecting the outer surface of the body to the longitudinal bore;

a cutting element comprising a cutting surface, wherein the cutting element is at least partially received within the opening and is configured to translate from a first position to a second position in response to a centrifugal force, wherein in the first position the cutting surface of the cutting element is retained in the body and does not extend beyond the outer surface, and wherein in the second position the cutting surface of the cutting element extends outwardly through the opening beyond the outer surface of the body; and a set screw having a longitudinal axis positioned within the longitudinal bore such that the longitudinal axis of the set screw is coaxial with a longitudinal axis of the bore.

27. The abrasive cutting tool of claim 26, wherein the body defines a second longitudinal bore configured to receive the set screw.

28. The abrasive cutting tool of claim 26, further comprising:

a plurality of the openings connecting the outer surface of the body to the longitudinal bore; and a plurality of the cutting elements, wherein each cutting element is at least partially received by an opening, is configured to translate from a first position to a second position in response to a centrifugal force, and wherein in the first position a cutting surface of the cutting element is retained in the body, and wherein in the second position the cutting surface of the cutting element extends outwardly through the opening beyond the outer surface of the body.

29. An abrasive cutting tool, comprising:

a body defining an outer surface, a longitudinal bore;

a plurality of openings connecting the outer surface of the body to the longitudinal bore; and a plurality of cutting elements, wherein each cutting element is at least partially received by an opening, and is configured to translate from a first position to a second position in response to a centrifugal force, wherein in the first position a cutting surface of the cutting element is retained in the body, and wherein in the second position the cutting surface of the cutting element extends outwardly through the opening beyond the outer surface of the body.

30. An abrasive cutting tool, comprising:

a body defining an outer surface, a longitudinal bore, and an opening connecting the outer surface of the body to the longitudinal bore; and a cutting element comprising a cutting surface, wherein the cutting element is at least partially received within the opening and is configured to translate from a first position to a second position in response to a centrifugal force, wherein in the first position the cutting surface of the cutting element is retained in the body and does not extend beyond the outer surface, and wherein in the second position the cutting surface of the cutting element extends outwardly through the opening beyond the outer surface of the body; and wherein the cutting element comprises a shoe.

31. An abrasive cutting tool, comprising:

a body defining an outer surface, a longitudinal bore, and an opening connecting the outer surface of the body to the longitudinal bore; and a cutting element comprising a cutting surface, wherein the cutting element is at least partially received within the opening and is configured to translate from a first position to a second position in response to a centrifugal force, wherein in the first position the cutting surface of the cutting element is retained in the body and does not extend beyond the outer surface, and wherein in the second position the cutting surface of the cutting element extends outwardly through the opening beyond the outer surface of the body; and wherein a reference line is formed on a periphery of the body.

32. A method comprising:

attaching a tool comprising a body including an outer surface and a translatable cutting element including a cutting surface to a rotary device;

retracting the translatable cutting element including the cutting surface into the body of the tool so that the cutting surface does not extend beyond the outer surface;

placing at least a portion of the body of the tool into a cylindrical article selected from a pipe and a tube;

rotating the tool using the rotary device to generate centrifugal force and thereby urge a portion the cutting element including the cutting surface to extend outwardly from the outer surface of the body; and abrading an inner wall of the cylindrical article with the cutting surface as the tool rotates within the cylindrical article; and wherein the body of the tool and at least a portion of the cutting element are comprised of the same material as the cylindrical article.

33. An abrasive cutting tool, comprising:

a body defining an outer surface, a longitudinal bore having a longitudinal axis, and an opening connecting the outer surface of the body to the longitudinal bore; and a cutting element comprising a cutting surface, wherein the cutting element is at least partially received within the opening and the cutting element slides within the opening in the body along an axis substantially perpendicular to the longitudinal axis from a first position to a second position in response to a centrifugal force, wherein in the first position the cutting surface of the cutting element is retained in the body and does not extend beyond the outer surface, and wherein in the second position the cutting surface of the cutting element extends outwardly through the opening beyond the outer surface of the body; and a set screw having a longitudinal axis positioned within the longitudinal bore such that the longitudinal axis of the set screw is coaxial with the longitudinal axis of the bore.

34. The abrasive cutting tool of claim 33, wherein the body defines a second longitudinal bore configured to receive the set screw.

35. An abrasive cutting tool, comprising:

a body defining an outer surface and including a longitudinal bore having a longitudinal axis;

a plurality of openings connecting the outer surface of the body to the longitudinal bore; and a plurality of cutting elements, wherein each cutting element comprises a cutting surface, is at least partially received within one of the openings, and is configured to slide within the opening along an axis substantially perpendicular to the longitudinal axis from a first position to a second position in response to a centrifugal force, wherein in the first position the cutting surface of the cutting element is retained in the body and does not extend beyond the outer surface, and wherein in the second position the cutting surface of the cutting element extends outwardly through the opening beyond the outer surface of the outer body.

36. An abrasive cutting tool, comprising:

a body defining an outer surface, a longitudinal bore having a longitudinal axis, and an opening connecting the outer surface of the body to the longitudinal bore; and a cutting element comprising a cutting surface, wherein the cutting element is at least partially received within the opening and the cutting element slides within the opening in the body along an axis substantially perpendicular to the longitudinal axis from a first position to a second position in response to a centrifugal force, wherein in the first position the cutting surface of the cutting element is retained in the body and does not extend beyond the outer surface, and wherein in the second position the cutting surface of the cutting element extends outwardly through the opening beyond the outer surface of the body;

wherein the cutting element comprises a shoe.

37. An abrasive cutting tool, comprising:

a body defining an outer surface, a longitudinal bore having a longitudinal axis, and an opening connecting the outer surface of the body to the longitudinal bore;

a cutting element comprising a cutting surface, wherein the cutting element is at least partially received within the opening and the cutting element slides within the opening in the body along an axis substantially perpendicular to the longitudinal axis from a first position to a second position in response to a centrifugal force, wherein in the first position the cutting surface of the cutting element is retained in the body and does not extend beyond the outer surface, and wherein in the second position the cutting surface of the cutting element extends outwardly through the opening beyond the outer surface of the body; and a reference line formed on the periphery of the body.

* * * * *